US007661420B2

(12) United States Patent
Okayasu

(10) Patent No.: US 7,661,420 B2
(45) Date of Patent: Feb. 16, 2010

(54) PORTABLE HEAT TRANSFER APPARATUS

(76) Inventor: Kenji Okayasu, 305, 1-3-1 Minamiazabu, Minato-ku, Tokyo (JP) 1060047

( * ) Notice: Subject to any disclaimer, the term of this patent is extended or adjusted under 35 U.S.C. 154(b) by 532 days.

(21) Appl. No.: 11/528,736

(22) Filed: Sep. 28, 2006

(65) Prior Publication Data

US 2007/0020575 A1 Jan. 25, 2007

Related U.S. Application Data

(63) Continuation of application No. PCT/JP2005/006060, filed on Mar. 30, 2005.

(30) Foreign Application Priority Data

Mar. 30, 2004 (JP) ..... 2004-098476

(51) Int. Cl.

| | |
|---|---|
| ***F24H 9/00*** | (2006.01) |
| ***F24H 1/00*** | (2006.01) |
| ***F23D 14/12*** | (2006.01) |
| ***F23D 14/14*** | (2006.01) |
| *F23D 14/18* | (2006.01) |

(52) U.S. Cl. ..... 126/210; 126/204; 431/328; 431/242; 431/243; 417/208; 122/4 D; 122/17.1

(58) Field of Classification Search ..... 417/208, 417/209; 431/326–328, 11, 242, 243; 122/4 D, 122/17.1

See application file for complete search history.

(56) References Cited

U.S. PATENT DOCUMENTS 3,561,903 A * 2/1971 Rubinstein et al. ..... 431/350
4,047,876 A * 9/1977 Rice ..... 431/7
4,212,593 A * 7/1980 Chadwick ..... 417/53
4,792,283 A * 12/1988 Okayasu ..... 417/52
4,881,593 A * 11/1989 Okayasu ..... 165/104.29
4,930,570 A * 6/1990 Okayasu ..... 165/104.14

(Continued)

FOREIGN PATENT DOCUMENTS

EP 0 514 922 A1 11/1992

(Continued)

OTHER PUBLICATIONS

Russian Patent Office, Official Action in Russian Patent Application No. 2006138013, Feb. 10, 2009.

*Primary Examiner*—Carl D Price
(74) *Attorney, Agent, or Firm*—Chapman and Cutler LLP

(57) ABSTRACT

A portable heat transfer apparatus comprises a mixture forming/supply device for producing a mixture of fuel gas and air, a heating unit including a heat collection casing, and a burner installed in the casing and formed with a combustion chamber having a flat surface. The burner includes a large number of holes formed on an upstream side thereof to extend up to the flat surface to allow the mixture injected into the chamber therethrough to combust in the chamber, and a porous solid radiant-heat conversion component to partly convert heat energy of exhaust gas from the combustion in the chamber into radiant heat energy. The conversion component defines at least a surface region of the chamber located opposite to a flame front produced close to the flat surface. The apparatus includes a heat-driven pump joined to the casing and receiving heat generated by the combustion, through the heat collection casing.

20 Claims, 7 Drawing Sheets

U.S. PATENT DOCUMENTS

| | | | | |
|---|---|---|---|---|
| 4,986,348 | A * | 1/1991 | Okayasu | 165/104.24 |
| 5,000,676 | A * | 3/1991 | Fiala | 431/7 |
| 5,129,788 | A * | 7/1992 | Okayasu | 417/52 |
| 5,282,740 | A * | 2/1994 | Okayasu | 431/344 |
| 5,326,257 | A | 7/1994 | Taylor et al. | |
| 5,938,427 | A * | 8/1999 | Suzuki et al. | 431/208 |
| 6,386,862 | B1 * | 5/2002 | Fujita et al. | 431/170 |
| 6,446,426 | B1 * | 9/2002 | Sweeney et al. | 60/39.81 |
| 6,632,085 | B1 * | 10/2003 | Suzuki et al. | 431/328 |
| 2009/0117505 | A1 * | 5/2009 | Okayasu | 432/221 |

FOREIGN PATENT DOCUMENTS

| | | | |
|---|---|---|---|
| EP | 514922 | A1 * | 11/1992 |
| JP | 57-198913 | | 12/1982 |
| JP | 64-019212 | | 1/1989 |
| JP | 03-117283 | | 5/1991 |
| JP | 04-347450 | | 12/1992 |
| JP | 09-126423 | | 5/1997 |
| JP | 11-141821 | | 5/1999 |

* cited by examiner

PORTABLE HEAT TRANSFER APPARATUS

TECHNICAL FIELD

This is a continuation of International Application PCT/JP2005/006060, with an international filing date of Mar. 30, 2005. Priority is claimed to Japan Patent Application Serial No. 2004-098476, filed on Mar. 30, 2004, which is hereby incorporated by reference. The present invention relates to a portable heat transfer apparatus equipped with an energy source in a self-contained manner and designed to supply heat to a heater or heated clothing usable in outdoor environments where any supply of electric power or fuel gas is difficult.

BACKGROUND ART

Heretofore, as an outdoor-type transportable heater, a gas heater and a body warmer have been widely prevalent However, these products have been inconvenient in that only a portion of user's body is warmed up or the level of warmth cannot be controlled. Further, heated clothing and a mat, each of which uses a battery and has an electrically resistive element distributed thereinside and adapted to generate heat based on electrical energy from the battery, have come into practical use. However, a mass energy density of latest batteries is still not so high, and therefore it is unable to supply required heating energy for a sufficient period of time.

With a view to solving this problem, the inventor of this application proposed an invention disclosed in Japanese Patent No. 3088127. Another invention publicly known by and disclosed in Japanese Patent Laid-Open Publication No. 09-126423 has come into practical use. These inventions are intended to use LPG as an energy source so as to overcome a disadvantage of batteries, and designed to burn LPG using a catalyst and extract resulting heat. In the former invention, the extracted heat acts to activate a heat-driven pump so as to transfer the heat by the medium of water. In the latter invention, the heat transfer is achieved by air convection.

As compared with flaming combustion, catalytic combustion is a tough combustion reaction capable of being uninterruptedly continued only by supplying fuel and air while maintaining a certain level of high-temperature environment, even if the wind blows or an air-fuel mixture ratio is slightly changed. Further, the catalytic combustion has a feature such that combustion is induced at a lower temperature than that in the flaming combustion. However, if the reaction is continued at a theoretical mixture ratio for a longer period of time, a combustion temperature will be excessively increased to cause deterioration of the catalyst. Thus, it is necessary to produce the reaction at a learn mixture ratio (excess in air). This inevitably leads to lowering of the combustion temperature to cause the need for increasing a heat transfer area required for activating the heat-driven pump and thereby increasing the size of a combustion chamber. Thus, there remains a problem in terms of portability. Moreover, it is impossible to use an atmospheric burner in view of the need for introducing air in large excess. In contrast, the flaming combustion originally has a high combustion temperature. Thus, the required heat transfer area can be reduced to facilitate downsizing, and a surface area of a heat generation section can be reduced to restrict heat leakage from the surface to the outside so as to provide enhanced heat efficiency. However, it is practically difficult to perform combustion of a fully pre-mixed mixture (fully pre-mixed combustion) within a narrow space surrounded by a peripheral wall. Such combustion is further difficult for the atmospheric burner designed to inject LPG from a nozzle and suck air based on a momentum of the injected LPG. While a flame can be maintained at a rich mixture ratio, it will be blown off before the mixture ratio reaches the theoretical mixture ratio. While a fan is typically used for forcibly supplying air (forced air supply) to achieve the fully pre-mixed combustion, such a forced-air fan cannot be used in a portable apparatus pursuing downsizing, because it has to be rotated using a motor requiring a power source, such as a battery.

DISCLOSURE OF THE INVENTION

It is an object of the present invention to provide a compact/lightweight portable heat transfer apparatus suitable for being carried or transported, and capable of performing flaming combustion of a fully premixed air-fuel mixture using an atmospheric burner while ensuring a stable combustion quality free of flame-out due to disturbances, and reducing heat loss to the outside so as to supply sufficient heat to a heat-driven pump.

According to the present invention, there is provided a portable heat transfer apparatus which comprises a mixture forming/supply device for producing a mixture of fuel gas and air, and a heating unit including a heat collection casing and a burner installed in the heat collection casing. The burner is formed with a combustion chamber having a flat surface. Further, the burner includes a large number of holes each formed on an upstream side thereof to extend up to the flat surface so as to serve as a burner port for injecting the mixture into the combustion chamber to perform combustion of the mixture in the combustion chamber, and a porous solid radiant-heat conversion component adapted to partly convert a heat energy of exhaust gas resulting from the combustion in the combustion chamber into a radiant heat energy. The porous solid radiant-heat conversion component defines at least a surface region of the combustion chamber located in opposed relation to a flame front to be produced close to the flat surface. The portable heat transfer apparatus further includes a heat-driven pump joined to the heat collection casing and adapted to receive heat generated by the combustion of the mixture in the combustion chamber, through the heat collection casing.

The mixture forming/supply device may comprise a venturi tube provided with an air intake duct and fluidically connected to the burner. In one embodiment of the present invention, the heat collection casing is configured to fully enclose the burner, and formed with a great number of holes constituting an upstream heat exchange section and a downstream heat exchange section. An exhaust duct is connected to the heat collection casing to establish fluid communication with the downstream heat exchange section, and a pair of wind protection plates are disposed adjacent, respectively, to an intake air inlet of the air intake duct and an exhaust gas outlet of the exhaust duct to protect against an adverse effect of disturbances of ambient air such as winds or turning upside down.

The air-gas mixture supplied from the mixture forming/supply device into the combustion chamber through the burner ports is ignited by sparks of a spark plug exposed to the combustion chamber to create flames around the flat surface of the combustion chamber. When resulting exhaust gas passes through the porous solid radiant-heat conversion component, a part of heat energy is converted into radiant heat energy by the porous solid radiant-heat conversion component, and returned toward the flame to accelerate a combustion reaction of the mixture. Thus, the flame is formed as a stable flame front resistant to "flame-out".

BEST MODE FOR CARRYING OUT THE INVENTION

Figure 1:
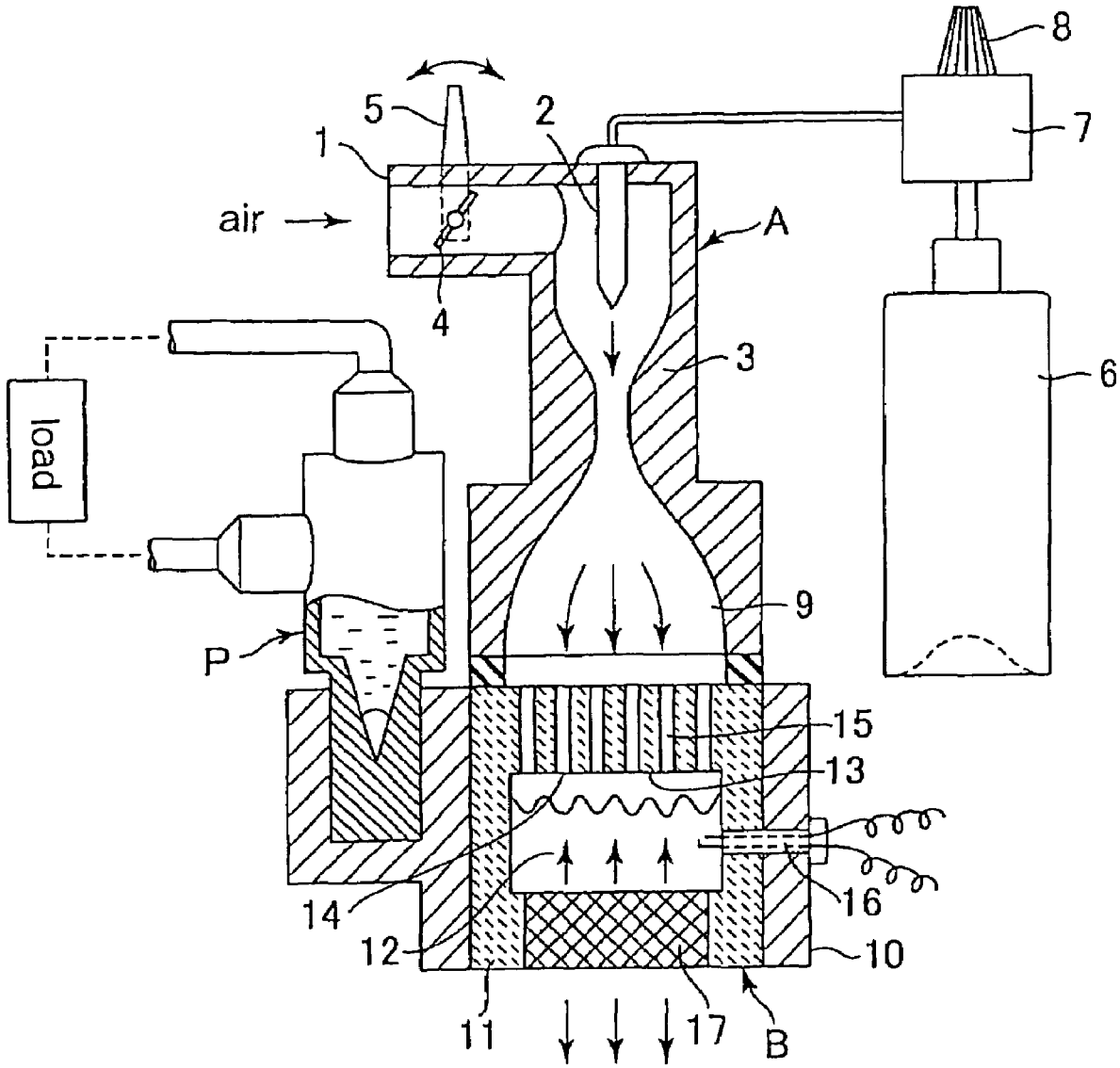
FIG. 1 is a sectional view showing one embodiment of a portable heat transfer apparatus of the present invention.

FIG. 1 is a sectional view showing one embodiment of a portable heat transfer apparatus of the present invention. This portable heat transfer apparatus fundamentally comprises a mixture forming/supply device A, a heating unit B and a heat-driven pump P. The mixture forming/supply device includes a venturi tube 3 having a supply duct 1 and a gas injection nozzle 2. The air intake duct 1 has a throttle valve 4. An opening angle of the throttle valve 4 can be externally adjusted using a lever 5 to freely change the volume of intake air. Gas (LPG) from a steel cylinder 6 is adjusted at a constant pressure by a pressure regulator 7, and then supplied to the gas injection nozzle 2. The gas injection nozzle 2 has an inner diameter of about ϕ40 to ϕ60 μm, and a gas pressure to be applied to the nozzle is preferably adjusted in the range of about $2.9\times10^4$ to 19.6 to $10^4$ Pa (gauge pressure) by rotating a pressure regulator knob 8. In the venturi tube 3, air is sucked from the air intake duct 1 by the action of an ejector, and then fuel gas is mixed with the air while reducing a flow volume of the air by the action of a diffuser 6. An air-gas mixture ratio of the resulting mixture can be changed by manually operating the lever 5 to adjust the opening degree of the throttle valve. While a rich mixture ratio is required during an ignition operation, it is desired to set the mixture at a mixture ratio slightly leaner than a theoretical mixture ratio during a steady operation in view of preventing incomplete combustion.

The heating unit B includes a burner 11 formed with a combustion chamber 12, and a heat collection casing 10 configured to surround the burner 11 and made of a heat conductor, such as alumina. The burner includes a large number of holes 15 formed on an upstream side thereof in spaced-apart relation to each other in such a manner as to extend up to a flat surface 13 so as to serve as a great number of burner ports 14. The combustion chamber 12 has an extremely small internal volume of 10 cc or less. The burner B is further provided with a spark plug 16 extending to be exposed to the combustion chamber 12.

The burner 11 is provided with a porous solid radiant-heat conversion component 17. In this embodiment, the porous solid radiant-heat conversion component 17 comprises a wire mesh formed by weaving a heat-resistant metal wire having a diameter of about ϕ0.1 to ϕ0.3.

Firstly, for the ignition operation, a mixture of fuel gas and air is set at a relatively high mixture ratio by adjusting the throttle valve using the lever 5 to reduce the air volume and is injected through the great number of holes 15 into the combustion chamber 12 of the burner 11. The mixture injected from the holes is formed as mixture vortexes around the outlet openings of the holes because of suddenly enlarged flat surface 13. Then, the mixture is ignited by sparks of the spark plug 16, and the vortexes are also ignited. The resulting flames from the great number of burner ports 14 are combined together to form a single flame front, and stabilized in the vicinity of the flat surface. The combustion causes an increase in temperature of a wall surface of the combustion chamber 12, and the resulting heat acts to warm a wall region above the burner ports 14 so as to preheat the mixture. Concurrently, high-temperature exhaust gas resulting from the combustion passes through the porous solid radiant-heat conversion component 17. The wire of the wire mesh forming the porous solid radiant-heat conversion component 17 has a small diameter, and therefore a temperature of the wire mesh is quickly increased up to several hundred degrees to allow the porous solid radiant-heat conversion component 17 to emit radian heat energy in all directions as electromagnetic waves. A part of the radian heat energy acts to heat an upstream region, i.e., the flame front, to drastically accelerate the combustion. In this connection, it was proven that a position of the porous solid radiant-heat conversion component 17 is one of key factors, i.e., the heat radiation effect is deteriorated if the position is excessively apart from the flame front, and no flame can be formed during the ignition operation if the position is excessively close to the flame front. In view of this knowledge, it is preferable to arrange the porous solid radiant-heat conversion component 17 at a position apart from the flat surface of the combustion chamber by 5 to 15 mm in a downstream direction. In this manner, heat energy of the exhaust gas can be recirculated to the flame in the form of radian heat energy. The mixture is strongly heated, and therefore a combustion speed will be gradually increased. It is necessary to continue this state for a while. Thus time period corresponds to a heating time period required for increasing the respective temperatures of the porous solid radiant-heat conversion component 17 and the burner 11 to assure a combustion function. Then, the lever 5 is moved to increase the opening degree of the throttle valve 4 so as to introduce a larger volume of air. Thus, the mixture has an increased flow volume, and an increased flow rate in the combustion chamber 12. In the conventional combustion chamber, the flame front is blown off during this process. Differently, the mixture heated through the preheating and the heat recirculation has a combustion speed withstanding the above increased flow rate to allow the flame front to be stably maintained in the combustion chamber without flame-out. Further, the mixture has a mixture ratio leaner (excess in air) than the theoretical mixture ratio. Thus, a complete combustion is performed to generate larger heat energy, and the larger heat energy will be used for the preheating and the heat recirculation so as to allow the flame stability to be increasingly enhanced. As above, the combustion speed can be increased to burn a larger volume of fuel gas in the small combustion chamber. Thus, this burner can be reduced in size as compared with a conventional catalytic burner having the same output, to have an optimal size as a burner for a portable heat transfer apparatus.

Heat generated in the combustion chamber 12 is collected by the heat collection casing 10 surrounding the burner 11, and transferred to the heat-driven pump P and then to an external load.

The wire mesh for use as the porous solid radiant-heat conversion component 17 may be a single layer to obtain an intended effect. While a plurality of wire meshes may be effectively layered, the multilayer wire mesh inevitably causes increase in resistance against an exhaust gas flow. Thus, in the atmospheric burner with relative low air intake performance, the use of multilayer wire mesh should be determined with an air intake volume in mind For the same reason, as to the density of meshes, #80 to #40 wire meshes may be generally used. Further, the wire mesh may be coated with ceramic material to prevent burnout. This is also advantageous to the wire mesh because ceramics has excellent heat radiation performance. Furthermore, instead of the wire mesh, foamed ceramics may be used.

Figure 2:
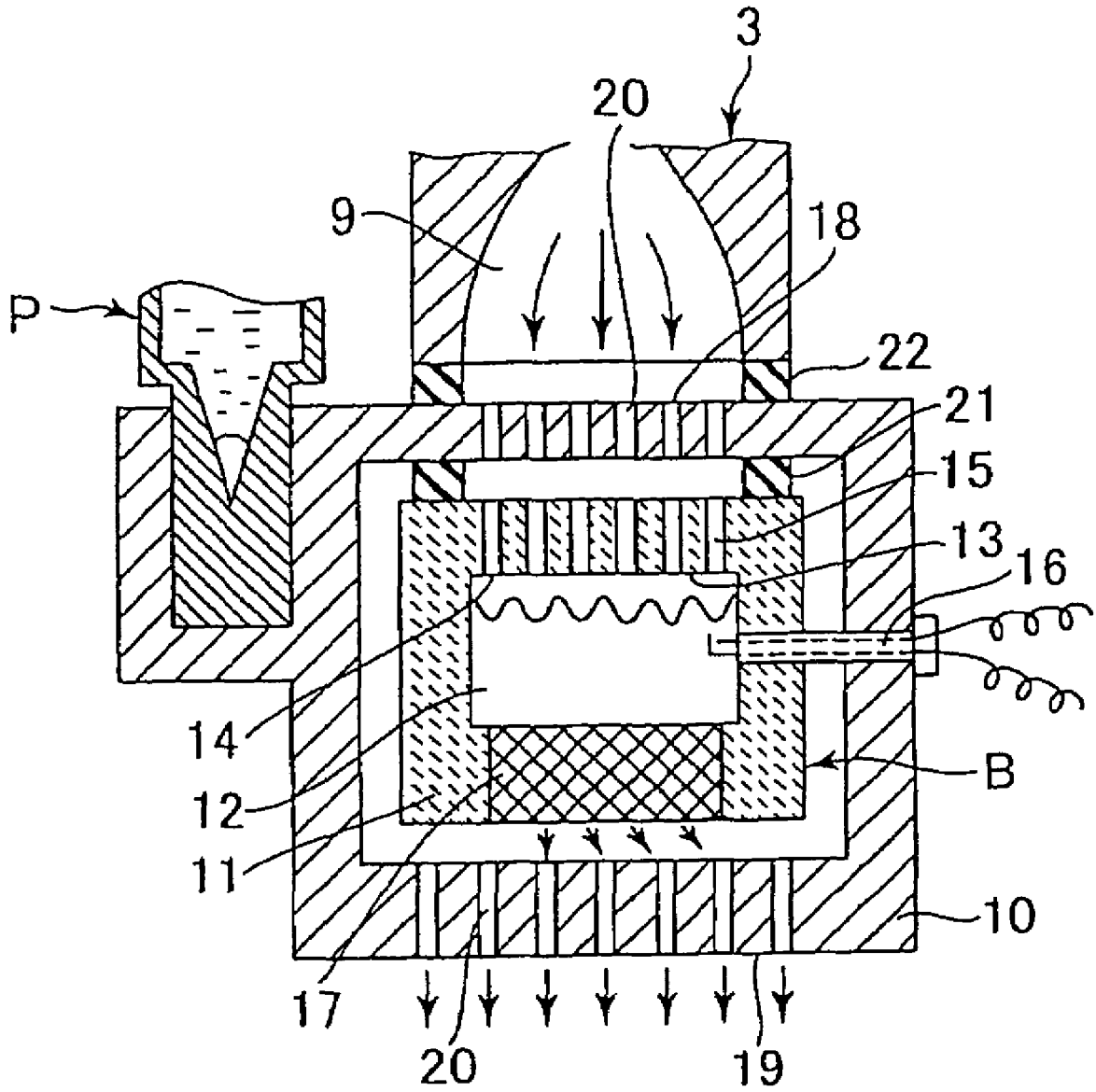
FIG. 2 is a sectional view showing another embodiment of the portable heat transfer apparatus according to of the present invention.

FIG. 2 shows another embodiment of the heat transfer apparatus according to the present invention. In this embodiment, a heat collection casing 10 of a burner 11 is made of a heat conductor, such as aluminum, as with the embodiment illustrated in FIG. 1, and configured to fully enclose the burner 11 in spaced-apart relation to define a space between the burner 11 and the casing 10. These are coupled to each other only by a heat-insulating seal 21 made of a heat-insulating material and disposed to surround an upper portion of the burner 11 for introducing the mixture therethrough. The heat collection casing 10 is formed with a large number of holes 20 constituting an upstream heat exchange section 18 and a downstream heat exchange section 19. An outer peripheral surface of the upstream heat exchange section is coupled to a venturi tube 3 through a heat-insulating seal 22. The burner 11 is provided with a porous solid radiant-heat conversion component 17 arranged in an outlet of a combustion chamber 12, in the same manner as that in the first embodiment. As above, a heat-insulating layer of air is formed between the burner 11 and the heat collection casing 10 to prevent heat generated in the combustion chamber 12 during combustion from being transferred to the heat collection casing 10 based on heat conduction. Thus, the burner 11 itself is heated up to a higher temperature than that of the first embodiment, to further accelerate the combustion. In addition, the mixture is additionally preheated by the upstream heat exchange section 18 in a two-stage manner, and therefore flames in the combustion chamber 12 will be less likely to be brown off, i.e., will be stabilized. Concurrently, heat of high-temperature exhaust gas is collected by the downstream heat exchange section 19, and then absorbed by a heat-driven pump P. Thus, the exhaust gas temperature becomes lower than that in the first embodiment, and consequently a larger amount of heat can be supplied to the heat-driven pump P without wasting the generated heat, while achieving further enhanced stability of flames.

While the burner 11 for use in this embodiment is preferably formed of a heat-resistant ceramics excellent in heat radiation performance, a heat-resistant metal, such as stainless steel, may also be adequately used without problems.

Figure 3:
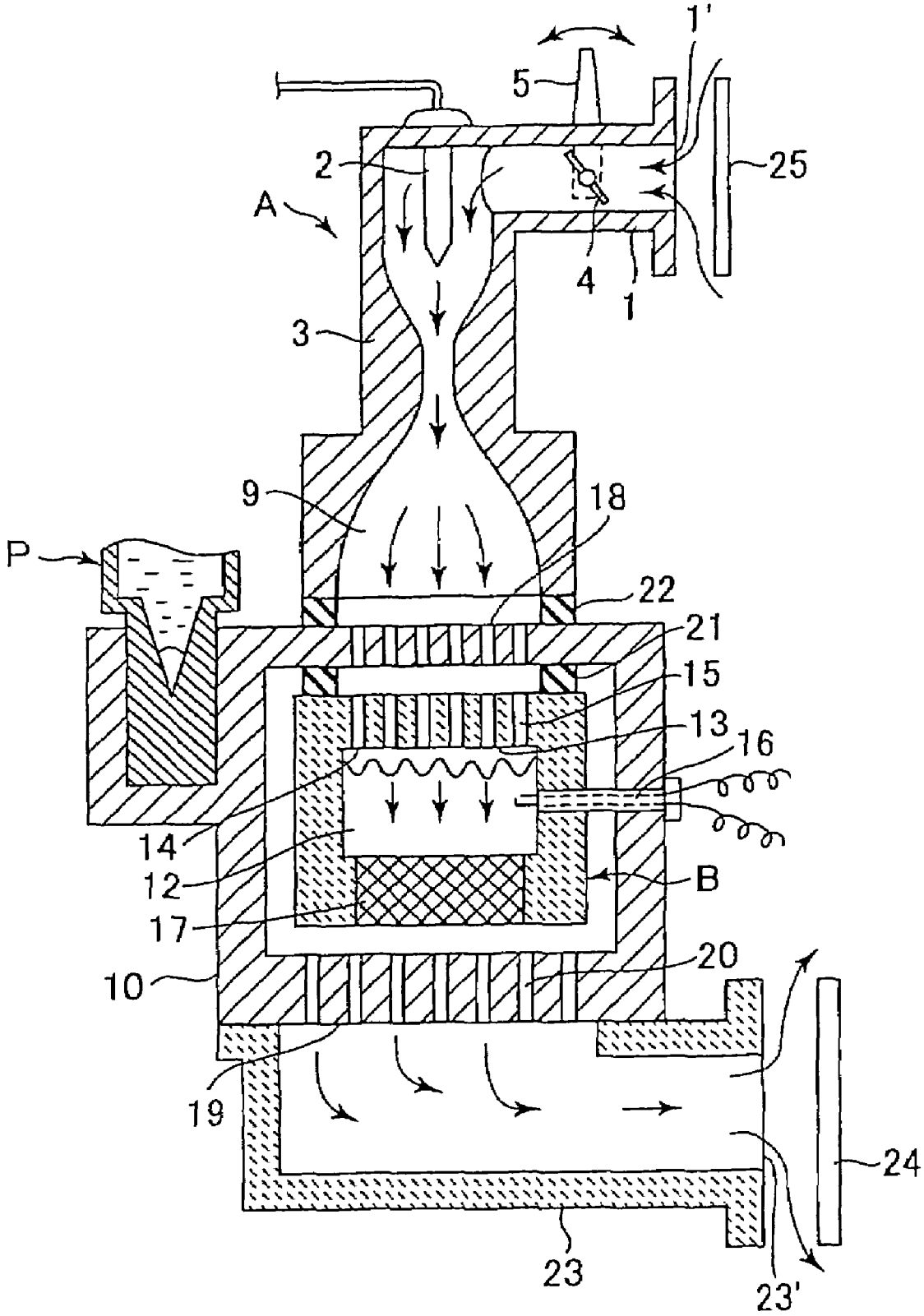
FIG. 3 is a sectional view showing yet another embodiment of the portable heat transfer apparatus according to of the present invention.

FIG. 3 shows yet another embodiment of the heat transfer apparatus according to the present invention. This embodiment is provided with an exhaust duct 23 for discharging exhaust gas passing through the downstream heat exchange section 19 in the second embodiment, and a wind protection plate 24 disposed on an outside and in the vicinity of an exhaust gas outlet 23' to protect against winds. Further, a wind protection plate 25 is disposed on an outside and in the vicinity of an intake air inlet 1' of an air intake duct 1. The intake air inlet and exhaust gas outlet are located in a common plane passing through axes of the air intake duct and the exhaust duct in the apparatus and in spaced-apart relation from each other. The reason is that the inlet and outlet are arranged to receive the same wind pressure when the wind blows, to prevent the occurrence of flame-out. Generally, a bath boiler is designed such that an intake air inlet and an exhaust gas outlet are integrally formed to perform heat exchange therebetween so as to reduce an exhaust loss. In this embodiment, the above arrangement can contribute to reducing the loss. However, the internal volume of the combustion chamber in the present invention is only the hundredth part of that in a bath boiler or the like, and thereby a combustion chamber load (an amount of heat generated in a combustion chamber/an internal volume $cm^3$ of the combustion chamber) is relatively high. This means that, while the temperature of the combustion chamber becomes higher, to provide enhanced stability of flames, combustion noise will become larger. This noise is classified into noise transmitted toward the intake air inlet through a diffuser and a venturi, and noise transmitted toward the exhaust gas outlet. Then, these noises are opened to atmosphere, and attenuated/vanished. If the intake air inlet and exhaust gas outlet are located close to each other, the inlet and outlet will be acoustically coupled together, and a resonance for increase the intensity of noise having only a specific frequency is likely to occur. Then, the noise will be converted to a pressure variation to blow off flames. This problem can be avoided only if respective gas-passage length between the intake air inlet and the combustion chamber and between the exhaust gas outlet and the combustion chamber are minimized, and the intake air inlet and exhaust gas outlet are arranged in spaced-apart relation to each other with a give distance therebetween. If it is necessary to arrange them in close relation to each other all anyhow, a wall has to be disposed therebetween to cut off the acoustic coupling. Each of the wind protection plates is necessary to have a size capable of fully covering over the intake air inlet or the exhaust gas outlet so as to prevent a wind pressure from directly acting on the inlet or outlet. Each of the wind protection plates is arranged in spaced-apart relation from the intake air inlet or the exhaust gas outlet to allow air to be taken or discharged through the space.

Figure 4:
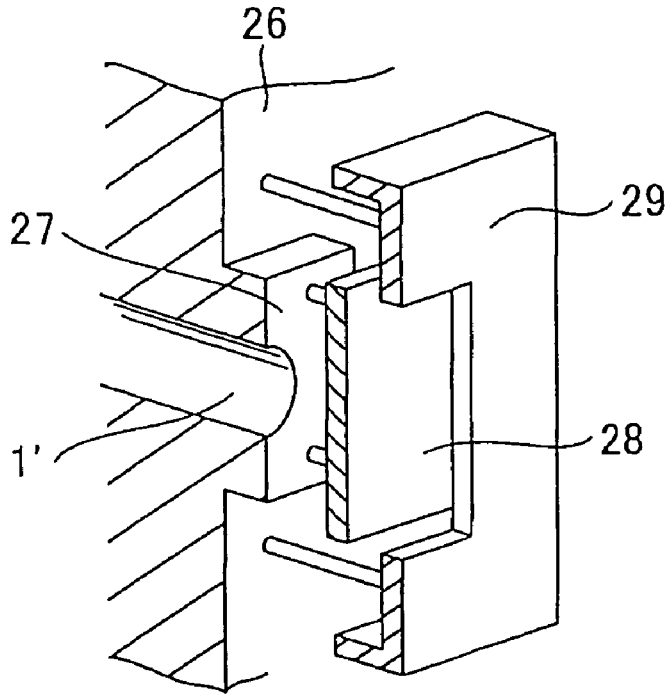
FIG. 4 is a fragmentary sectional perspective view showing another example of a wind protection device in the portable heat transfer apparatus according to the present invention.
Figure 5:
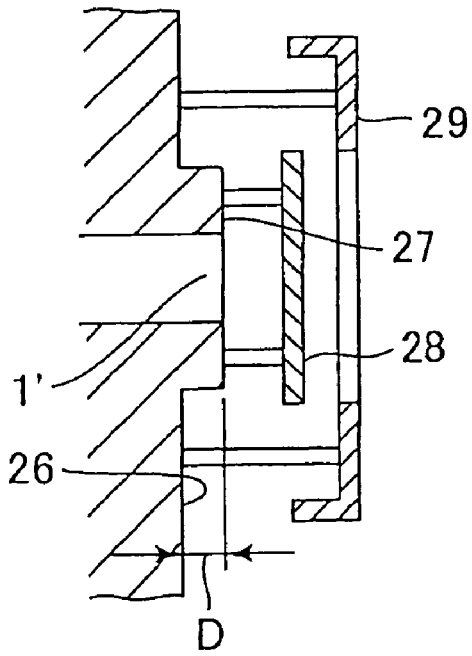
FIG. 5 is a fragmentary sectional side view of the wind protection device illustrated in FIG. 4.

FIGS. 4 and 5 show a further effective wind protection system. An intake air inlet 1' is opened in a protruded surface 27 formed to protrude from a surface 26 by a distance D. This makes it possible to eliminate an adverse effect of wind changed in direction due to collision with the surface 26 to flow parallel to the surface 26. Further, a first wind protection plate 28 similar to the wind protection plate 25 and a second wind protection plate 29 as illustrated in FIGS. 4 and 5 are arranged in spaced-apart relation from each other. In this arrangement, a pressure variation due to air vortexes occurring at edges of the wind protection plates due to wind gust can be reduced in a two-stage manner. Further, this structure can prevent the intake air inlet from being adversely affected by wind from an obliquely lateral direction.

This double wind protection plates and the protruded surface are also applied to the exhaust air outlet. This effect is significant, and a burner for a portable heat transfer apparatus intended to stably use outdoors without flame-out even in wind with a wind speed of about 20 m/sec.

Figure 6:
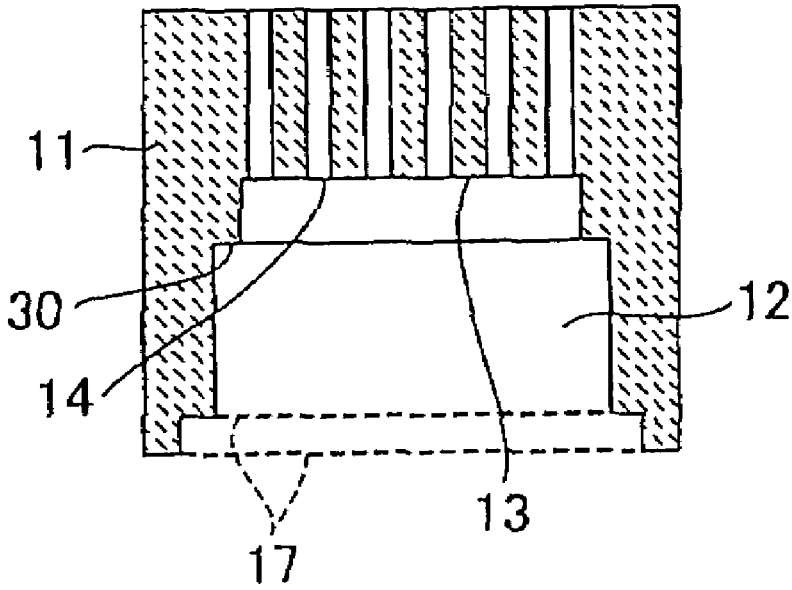
FIG. 6 is a sectional view showing another example of a burner in the portable heat transfer apparatus according to the present invention.

FIG. 6 shows one example of a burner of a heating unit for use in the portable heat transfer apparatus according to the present invention. A burner 11 is entirely formed of a material, such as ceramics, excellent in resistance in high temperatures and in heat insulating performance. As shown in FIG. 6, this burner includes a large number of burner ports 14 each formed to extend up to a flat surface 13 in contact with a combustion chamber. Each of the burner ports has a certain extent of length, and serves to transfer heat to a mixture and to block backfire. The burner port has a diameter of about $\phi 0.8$ to $\phi 1.2$. A step 30 is formed on a downstream side of the flat surface 13 to increase an sectional area of the combustion chamber, and two layers of wire meshes serving as a porous solid radiant-heat conversion component 17 are arranged at a position away from the step on the downstream side of the step. When it is necessary to increase an output during combustion in a steady state, the gas pressure of the nozzle may be increased to inject a larger volume of fuel gas. Then, a correspondingly increased volume of air is introduced from the intake air inlet, and a larger volume of mixture is introduced into the combustion chamber. A flame front is moved in the downward direction as the flow speed of the mixture is increased. During this process, the flow speed is lowered at the step 30 and further vortexes are generated around the step to allow the flame front to be stabilized. Thus, a region on an inward side of this step 30 becomes one large burner port. This makes it possible to burn a large volume of mixture. Further, the thermal output can be selectively increased and reduced.

Figure 7:
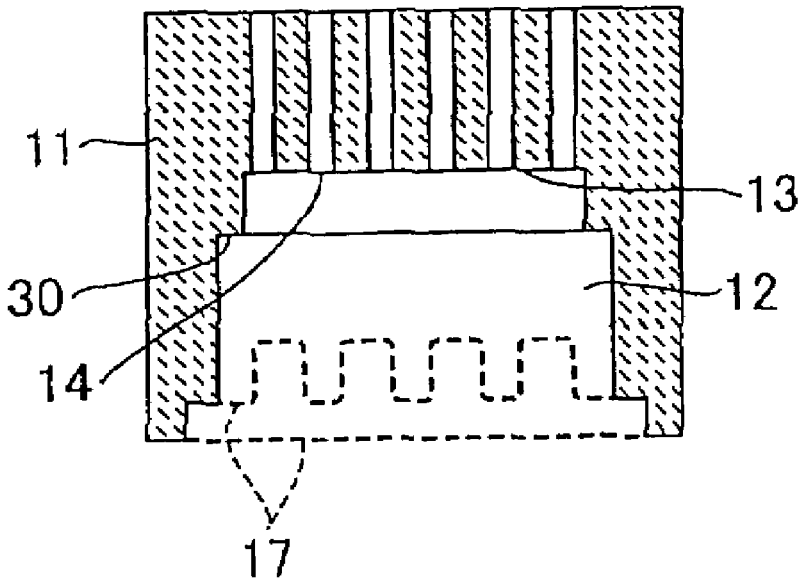
FIG. 7 is a sectional view showing yet another example of the burner.

FIG. 7 shows yet another example of the burner in a heating section. Among two layers of wire meshes, a first layer includes a chevron-shaped wire mesh formed in a chevron shape. This makes it possible to increase a surface area of the wire mesh and reduce a resistance against an exhaust gas flow. While the second layer may also be formed in a chevron shape, it is preferable to form it in a flat shape as shown in FIG. 7 and reduce the density of meshes.

Figure 8:
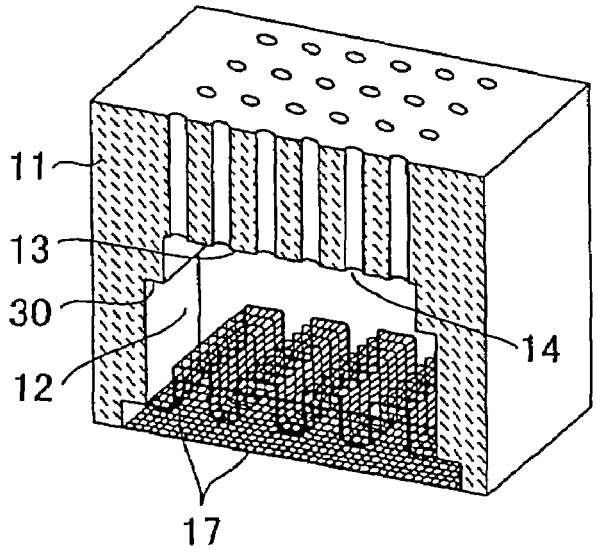
FIG. 8 is a sectional perspective view of the burner illustrated in FIG. 7.

FIG. 8 is a sectional perspective view of the burner illustrated in FIG. 7, wherein the chevron-shaped wire mesh is more clearly illustrated.

Figure 9:
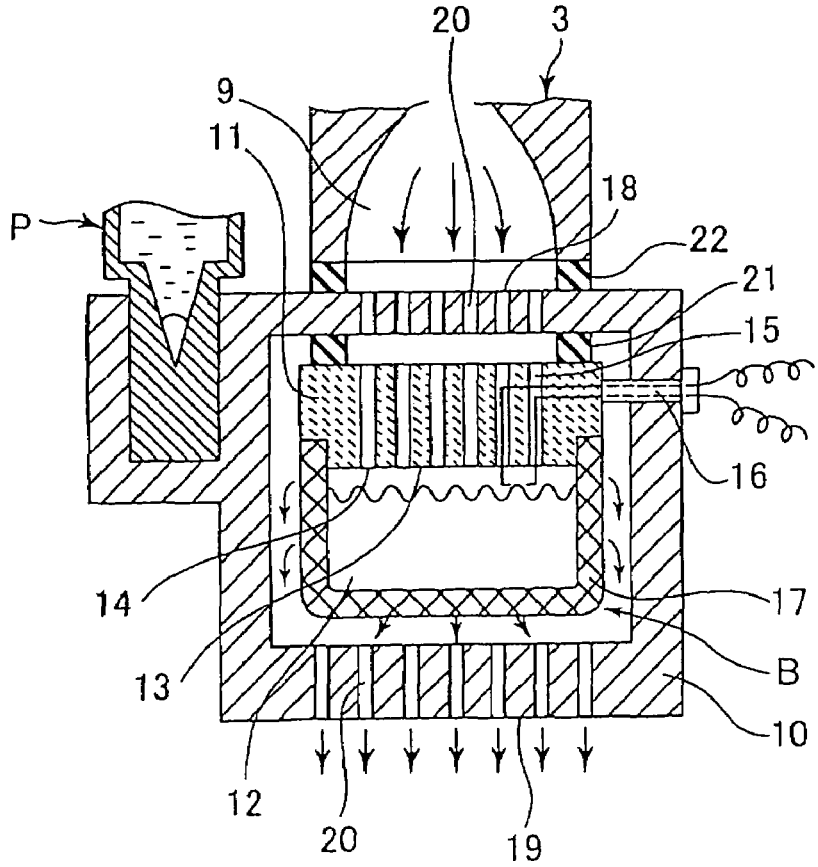
FIG. 9 is a modification of the embodiment illustrated in FIG. 2.
Figure 10:
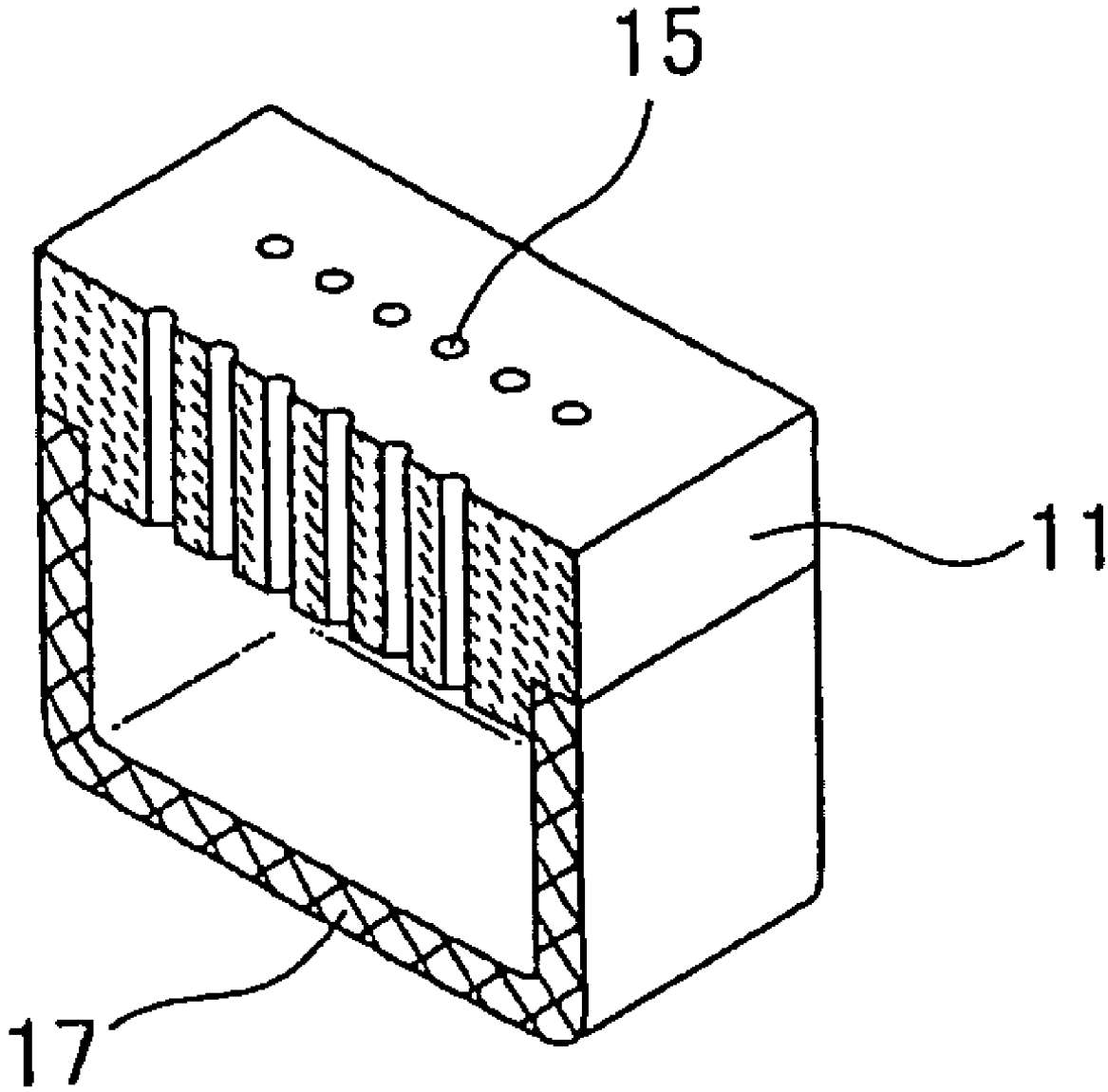
FIG. 10 is a partially cut-out perspective view showing a burner in the embodiment illustrated in FIG. 9.

FIG. 9 is a modification of the embodiment illustrated in FIG. 2. Except for a large portion of surface of the combustion chamber 12 of the burner 11 including the surface region opposed to the flame front is defined by a porous solid radiant-heat conversion component 17, this embodiment is the same as the embodiment illustrated in FIG. 2. As clearly shown in FIG. 10, this porous solid radiant-heat conversion component 17 is formed in a basket-like shape, and attached to the burner 11 by a fitting engagement with a cutout portion formed along a circumferential direction of the burner 11. In this structure, the surface area of the porous solid radiant-heat conversion component is significantly increased, and therefore the resistance to an exhaust gas flow is effectively reduced as a whole. Thus, when a wire mesh is used as a porous solid radiant-heat conversion component, a wire mesh having a higher density of meshes than the aforementioned embodiments can be used, and the number of layers can be increased. A martial of the porous solid radiant-heat conversion component may include plural layers of wire meshes, a foamed ceramics, a mat-shaped ceramics fiber or a sintered mat-shaped heat-resistant alloy fiber.

What is claimed is:

1. A portable heat transfer apparatus comprising:

a mixture forming/supply device for producing a mixture of fuel gas and air;

a heating unit including a heat collection casing, and a burner installed in said heat collection casing and formed with a combustion chamber having a flat surface, said burner including a large number of holes each formed on an upstream side thereof to extend up to said flat surface so as to serve as a burner port for injecting the mixture into the combustion chamber to perform combustion of said mixture in the combustion chamber, and a porous solid radiant-heat conversion component adapted to partly convert a heat energy of exhaust gas resulting from said combustion in the combustion chamber into a radiant heat energy, said, porous solid radiant-heat conversion component defining at least a surface region of the combustion chamber located in opposed relation to a flame front to be produced close to said flat surface; and a heat-driven pump joined to the heat collection casing and adapted to receive heat generated by the combustion of the mixture in the combustion, chamber, through then heat collection casing, wherein said heat collection casing is configured to fully enclose said burner in spaced-apart relation to define a space between said burner and said casing, and formed with a great number of holes constituting an upstream heat exchange section and a downstream heat exchange section, and wherein said heat collection casing is adapted to perform heat exchange when the exhaust gas from the combustion chamber passes through said downstream heat exchange section, and transfer said received heat in such a manner as to be used for preheating the mixture in said upstream heat exchange section and for heating said heat-driven pump.

2. The portable heat transfer apparatus as defined in claim 1, wherein said mixture forming/supply device comprises a venturi tube provided with an air intake duct and connected to the burner, said venturi tube including a gas injection nozzle, an ejector and a diffuser.

3. The portable heat transfer apparatus as defined in claim 2, wherein said venturi tube comprises a throttle valve provided in said air intake duct, and a pressure regulator associated with said gas injection nozzle on its upstream side.

4. The portable heat transfer apparatus as defined in claim 2, wherein said porous solid radiant-heat conversion component is formed of a foamed ceramic.

5. The portable heat transfer apparatus as defined in claim 2, wherein said porous solid radiant-heat conversion component is formed of plural layers of wire meshes.

6. The portable heat transfer apparatus as defined in claim 2, wherein said combustion chamber has an internal volume of 10 cc or less.

7. The portable heat transfer apparatus as defined in claim 1, wherein a large portion of surface of the combustion chamber of said burner including said surface region opposed to the flame front is defined by said porous solid radiant-heat conversion component.

8. The portable heat transfer apparatus as defined in claim 7, wherein said porous solid radiant-heat conversion component is formed of one of the group consisting of plural layers of wire meshes, a foamed ceramic, a mat-shaped ceramics fiber, and a sintered mat-shaped heat-resistant alloy fiber.

9. The portable heat transfer apparatus as defined in claim 7, wherein said air intake duct and said exhaust duct have, respectively, an intake air inlet and an exhaust gas outlet located in the same orientation and in a spaced-apart relation from each other, each of said inlet and outlet being provided with a wind protection plate on the outside and in the vicinity thereof, said wind protection plate having a size capable of fully covering over a corresponding one of said inlet and outlet.

10. The portable heat transfer apparatus as defined in claim 1, comprising an exhaust duct in fluid communication with the downstream heat exchange section of said heat collection casing.

11. The portable heat transfer apparatus as defined in claim 10, comprising an intake air inlet and an exhaust gas outlet opened, respectively, in independent protruded surfaces located in the same orientation and in a spaced-apart relation from each other, each of said inlet and outlet being provided with a pair of wind protection plates on the outside and in the vicinity thereof, said pair of wind protections being each formed to have a size capable of fully covering over a corresponding one of said inlet and outlet, and arranged overlappingly in spaced-apart relation to each other.

12. The portable heat transfer apparatus as defined in claim 1, wherein said porous solid radiant-heat conversion component is formed of a foamed ceramic.

13. The portable heat transfer apparatus as defined in claim 1, wherein said porous solid radiant-heat conversion component is formed of plural layers of wire meshes.

14. The portable heat transfer apparatus as defined in claim 13, wherein one or more of said wire meshes have a chevron shape.

15. The portable heat transfer apparatus as defined in claim 1, wherein:

said heat collection casing is made of a heat conductor including aluminum; and said burner is made of a heat-resistant ceramic material excellent in heat-radiating performance.

16. The portable heat transfer apparatus as defined in claim 1, wherein said combustion chamber includes a step for flame holding, formed at a downstream position of said flat surface having the burner ports in such a manner as to sharply increase a sectional area of the combustion chamber ma downstream direction.

17. The portable heat transfer apparatus as defined in claim 16, wherein said combustion chamber has an internal volume of 10 cc or less.

18. The portable heat transfer apparatus as defined in claim 1, wherein said combustion chamber has an internal volume of 10 cc or less.

19. The portable heat transfer apparatus as defined in claim 18, wherein:

said heat collection casing is made of a heat conductor including aluminum; and said burner is made of a heat-resistant ceramic material excellent in heat-radiating performance.

20. The portable heat transfer apparatus as defined in claim 18, wherein said combustion chamber includes a step for flame holding, formed at a downstream position of said flat surface having the burner ports in such a manner as to sharply increase a sectional area of the combustion chamber in a downstream direction.

* * * * *